US009624639B2

(12) United States Patent
Somerfield

(10) Patent No.: US 9,624,639 B2
(45) Date of Patent: Apr. 18, 2017

(54) GROUND ANCHOR

(71) Applicant: Gripple Limited, Sheffield, South Yorkshire (GB)

(72) Inventor: Alan Somerfield, Lincolnshire (GB)

(73) Assignee: GRIPPLE LIMITED (GB)

( * ) Notice: Subject to any disclaimer, the term of this patent is extended or adjusted under 35 U.S.C. 154(b) by 0 days.

(21) Appl. No.: 14/787,155

(22) PCT Filed: Apr. 28, 2014

(86) PCT No.: PCT/GB2014/000161
§ 371 (c)(1),
(2) Date: Oct. 26, 2015

(87) PCT Pub. No.: WO2014/177825
PCT Pub. Date: Nov. 6, 2014

(65) Prior Publication Data

US 2016/0102442 A1 Apr. 14, 2016

(30) Foreign Application Priority Data

Apr. 29, 2013 (GB) ..... 1307655.9
Apr. 1, 2014 (GB) ..... 1405830.9
Apr. 24, 2014 (GB) ..... 1407221.9

(51) Int. Cl.
*E02D 5/80* (2006.01)

(52) U.S. Cl.
CPC ..... *E02D 5/80* (2013.01); *E02D 5/803* (2013.01)

(58) Field of Classification Search
CPC ..... E02D 2/80; E02D 2/803; E04H 12/2215; A45F 3/44
USPC ..... 52/155, 156, 158, 159, 160, 162–166; 405/259.1, 253, 254, 259.4, 258.1; 248/156, 530
See application file for complete search history.

(56) References Cited

U.S. PATENT DOCUMENTS 3,772,838 A 11/1973 Virnig
4,802,317 A * 2/1989 Chandler ..... E02D 5/803 52/163
5,031,370 A * 7/1991 Jewett ..... E02D 5/80 285/417
5,058,337 A * 10/1991 O'Connor ..... A01G 17/14 256/1
5,649,788 A * 7/1997 Jewett ..... E02D 5/80 175/19
5,775,037 A * 7/1998 James ..... E02D 5/74 256/DIG. 5

(Continued)

FOREIGN PATENT DOCUMENTS

GB 2283511 5/1995
GB 2485877 5/2012

(Continued)

*Primary Examiner* — Theodore Adamos
(74) *Attorney, Agent, or Firm* — James R. Foley; Clark Hill PLC

(57) ABSTRACT

A ground anchor (10) comprises a body (12) and a ground piercing means (40) on the body. The ground piercing means comprises a tapering member (42) having opposite edges (48) that taper towards each other from the body. The tapering member may have two opposite faces (50) extending between the opposite edges, the opposite faces being substantially parallel to each other.

17 Claims, 7 Drawing Sheets

(56) References Cited

U.S. PATENT DOCUMENTS

| | | | | |
|---|---|---|---|---|
| 5,899,165 | A * | 5/1999 | Komura | B63B 21/22 114/294 |
| 6,237,289 | B1 * | 5/2001 | Jewett | E02D 5/803 405/259.1 |
| D572,546 | S * | 7/2008 | Stahm | D8/1 |
| 7,534,073 | B2 * | 5/2009 | Stahm | E02D 5/80 405/259.1 |
| 7,695,219 | B2 * | 4/2010 | Carpenter | E02B 3/126 405/16 |
| 2006/0180719 | A1 * | 8/2006 | Cooper | E04H 12/2215 248/156 |
| 2008/0034682 | A1 * | 2/2008 | Carpenter | E02D 5/74 52/155 |
| 2009/0041548 | A1 * | 2/2009 | Stahm | E02D 17/20 405/259.1 |

FOREIGN PATENT DOCUMENTS

| | | |
|---|---|---|
| SU | 1135846 | 1/1985 |
| WO | 2013009364 | 1/2013 |

* cited by examiner

GROUND ANCHOR

This invention relates to ground anchors. More particularly, but not exclusively, this invention relates to ground anchors that can be driven into the ground and pulled into a load bearing position when driven to a desired position in the ground.

Ground anchors are used to secure and stabilise building structures and the like. Examples of ground anchors are disclosed in GB 2283511 and GB 2283512. The ground anchors disclosed in each of these prior documents can receive a driving rod which is used to drive the ground anchors onto the ground. The ground anchors are driven into the ground through matting which is used to stabilise the ground surface. If the required amount of care is not taken, the matting can be torn when the ground anchors are driven through it.

According to one aspect of this invention, there is provided a ground anchor comprising a body and a ground piercing means on the body, wherein the ground piercing means comprises a substantially flat tapering member.

The tapering member may have opposite edges that taper towards each other.

According to another aspect of this invention, there is provided a ground anchor comprising a body and a ground piercing means on the body, wherein the ground piercing means comprises a tapering member having opposite edges that taper towards each other.

The tapering member may have opposite faces extending between the opposite edges. The opposite faces may be substantially parallel to each other. Each of the opposite faces may be substantially flat. Each of the opposite faces may be substantially triangular.

The ground anchor may include a drive formation for co-operating with a drive means for driving the ground anchor into the ground. The drive means may comprise an elongate driving article, and may comprise a shaft and an impulse receiving formation.

The drive formation may be an elongate hole, which may be a blind hole. The elongate hole may extend substantially axially into the body from an opening in a rear end of the body.

The ground anchor may further include a securing formation for securing a ground stabilising arrangement thereto. The securing formation may be an apertured portion of the body. The apertured portion may define an aperture therethrough.

The stabilising arrangement may comprise a connecting article, such as a wire rope cable or the like, and a stabilising article attached to the connecting article. The connecting article may extend through the securing aperture defined by the aperture portion of the body.

The ground piercing means may comprise a plurality of tapering members. At least one of the tapering members may extend transverse to another of the tapering members.

The ground piercing means may comprise a first tapering member and a plurality of second tapering members extending transverse to the first tapering member. The first tapering member may be a main tapering member.

Each of the tapering members may have opposite edges that taper towards each other. Each of the tapering members may have opposite faces extending between the opposite edges. The opposite faces may be substantially parallel to each other. Each of the opposite faces may be substantially flat. Each of the opposite faces may be substantially triangular.

The body may have a main axis, and the, or each, tapering member may comprise first and second edges, at least one of which may extend at an acute angle relative to the main axis. Desirably, both of the first and second edges of the, or each, tapering member may extend at an acute angle relative to the main axis. The first and second edges may extend at substantially the same acute angle relative to the main axis.

The ground piercing means may further include teeth provided on the body in regions adjacent the, or each, tapering member. The teeth may comprise serrations.

The body may have a front end and a rear end, the ground piercing means being provided at the front end of the body. The front end of the body may have a front substantially V shaped formation, which may include first and second front faces. Each of said front faces may extend on respective opposite sides of the first tapering member. The teeth may be provided on said first and second front faces.

The first and second front faces may extend transverse to the first tapering member. In a first embodiment, the first and second front faces may extend substantially at right angles to the first tapering member. In the first embodiment, the teeth may extend substantially at right angles to the first tapering member. In a second embodiment, the first and second front faces taper rearwardly from the first tapering member. In the second embodiment, the teeth may taper rearwardly from the first tapering member.

Embodiments of the invention will now be described by way of example only, with reference to the accompanying drawings, in which.

Figure 1:
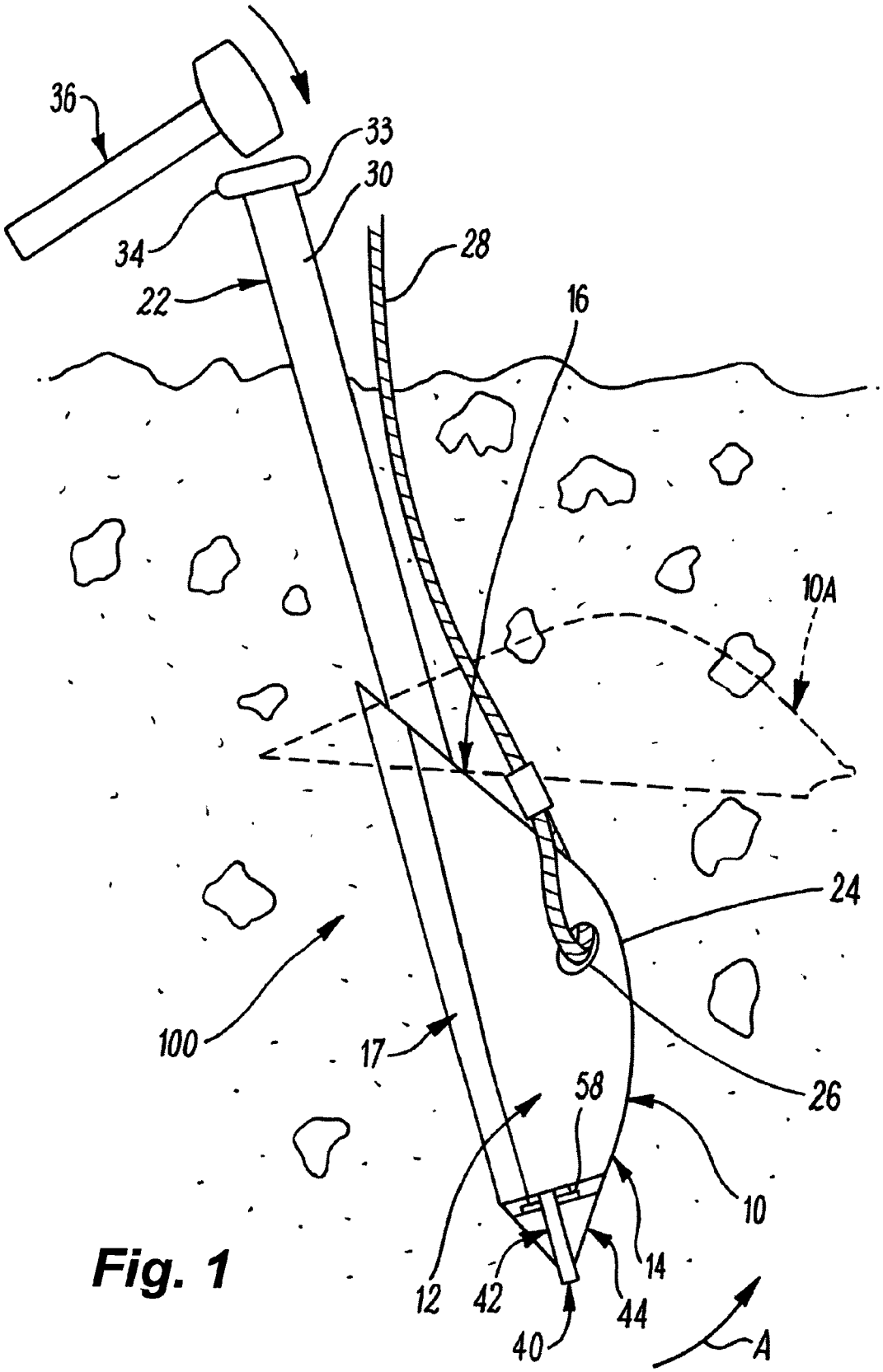
FIG. 1 is a side view of a first embodiment of a ground anchor being driven into the ground.
Figure 2:
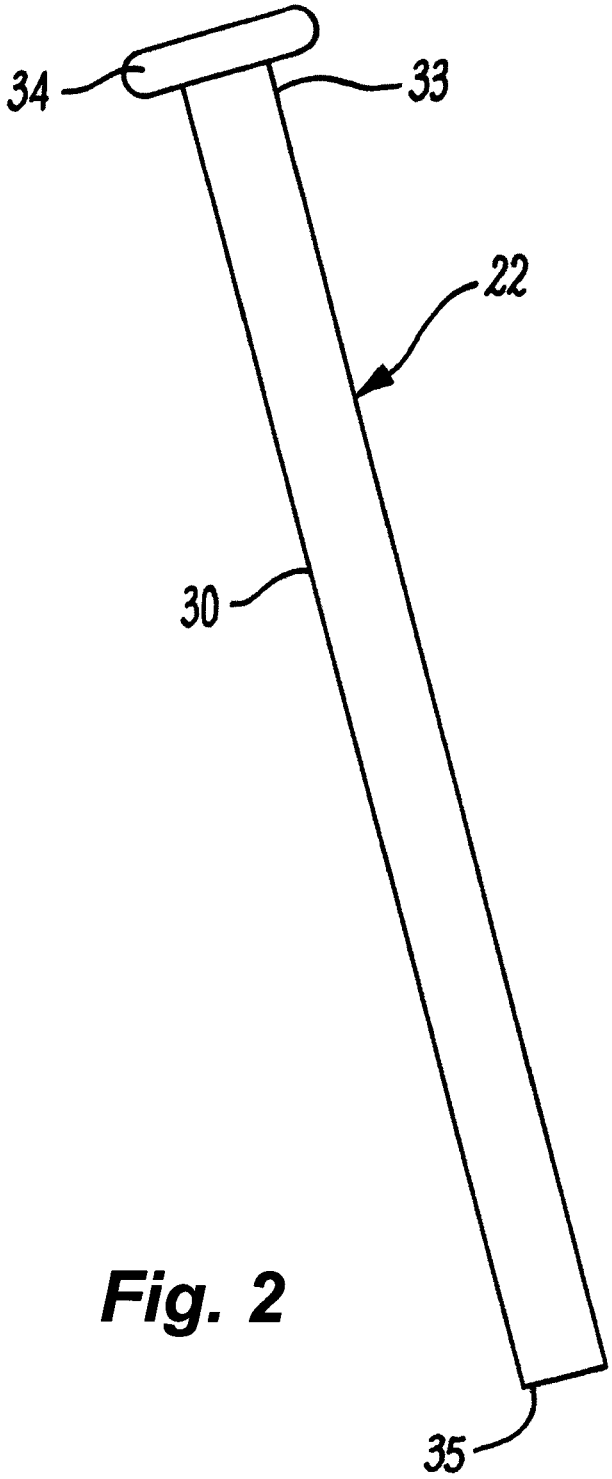
FIG. 2 shows a driving arrangement for use in driving the ground anchor shown in FIG. 1 into the ground.
Figure 3:
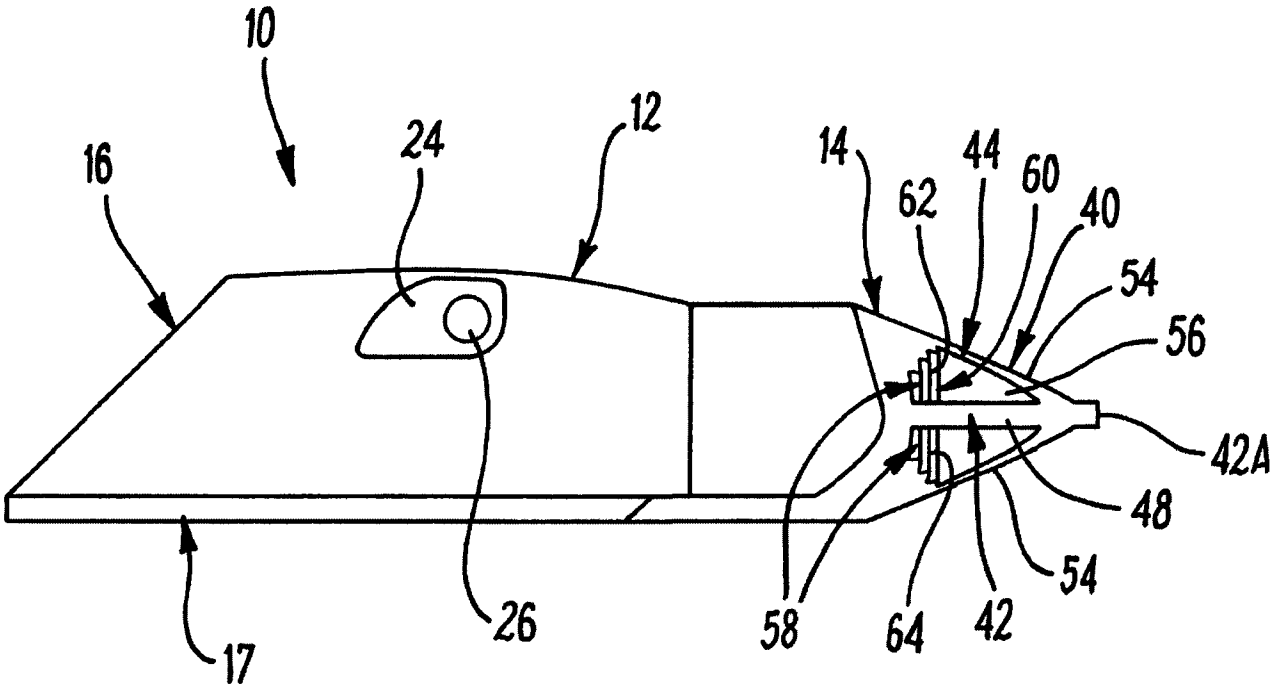
FIG. 3 is a side view of a second embodiment of a ground anchor.
Figure 4:
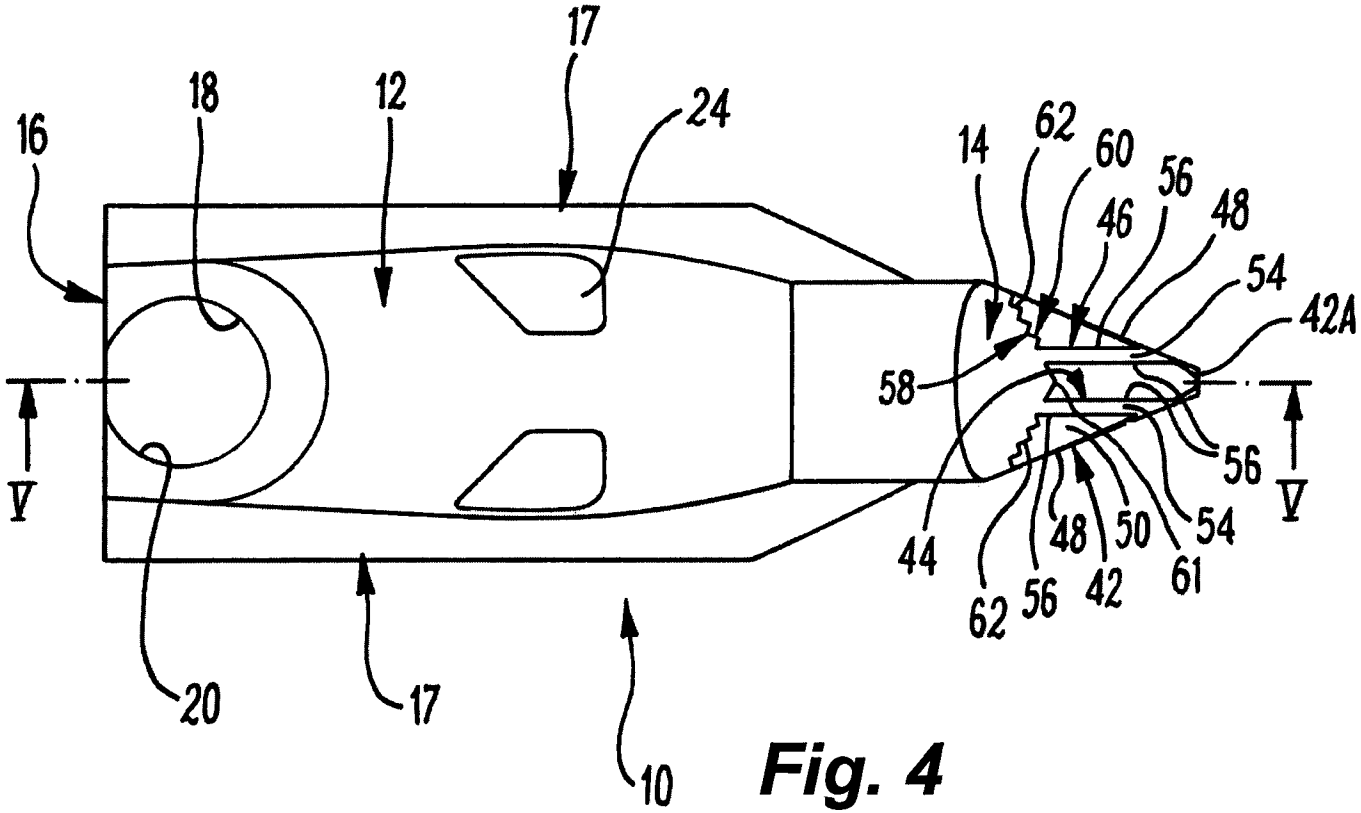
FIG. 4 is a top plan view of the ground anchor shown in FIG. 3.
Figure 5:
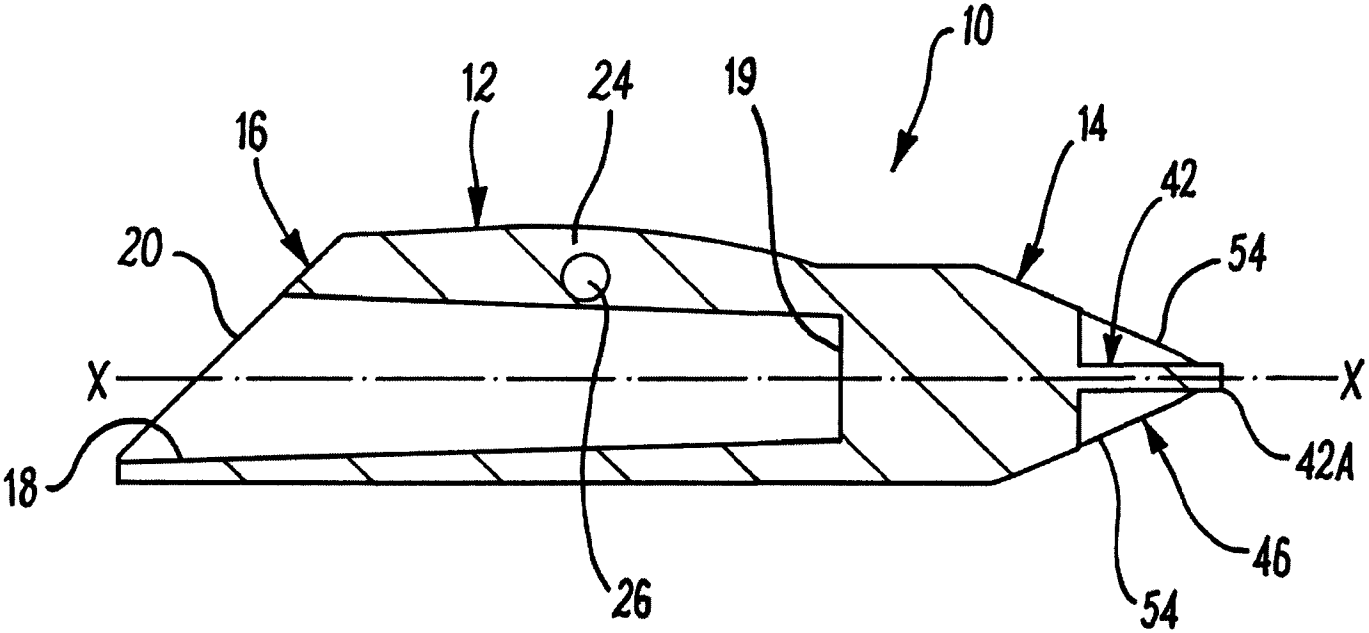
FIG. 5 is a sectional view along the lines V-V in FIG. 4.
Figure 6:
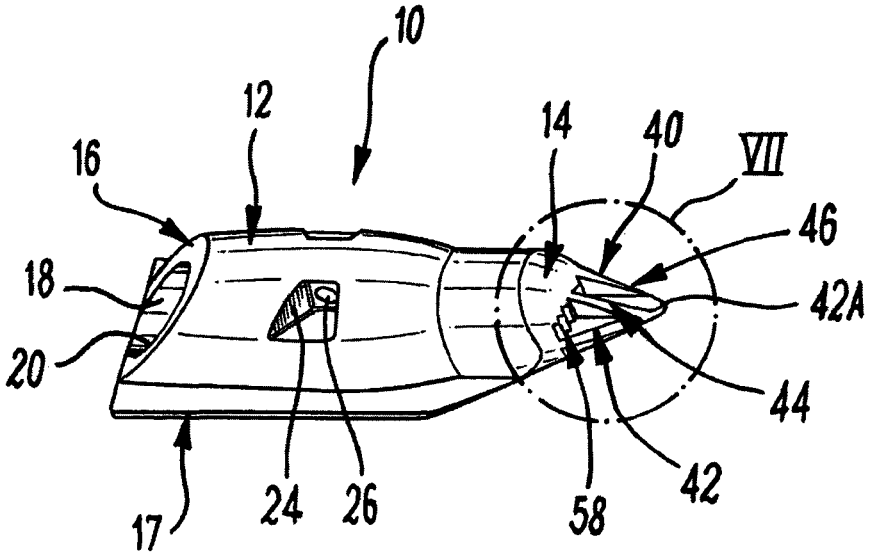
FIG. 6 is a perspective view of the ground anchor shown in FIGS. 3 to 5.
Figure 7:
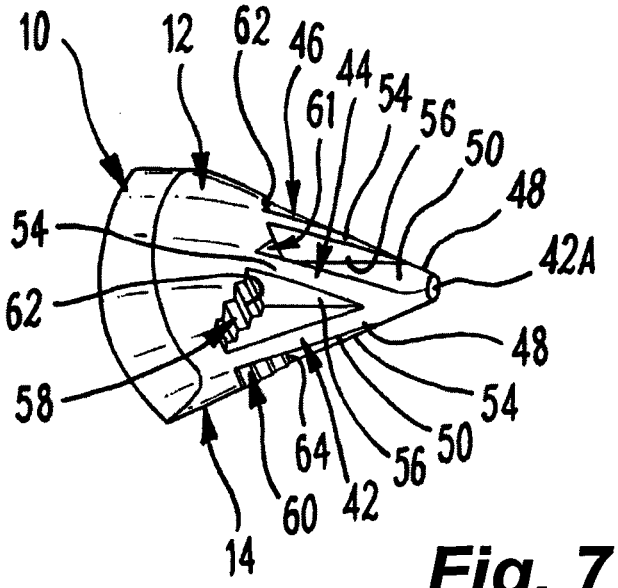
FIG. 7 is a close up view of the region marked VII in FIG. 6.
Figure 8:
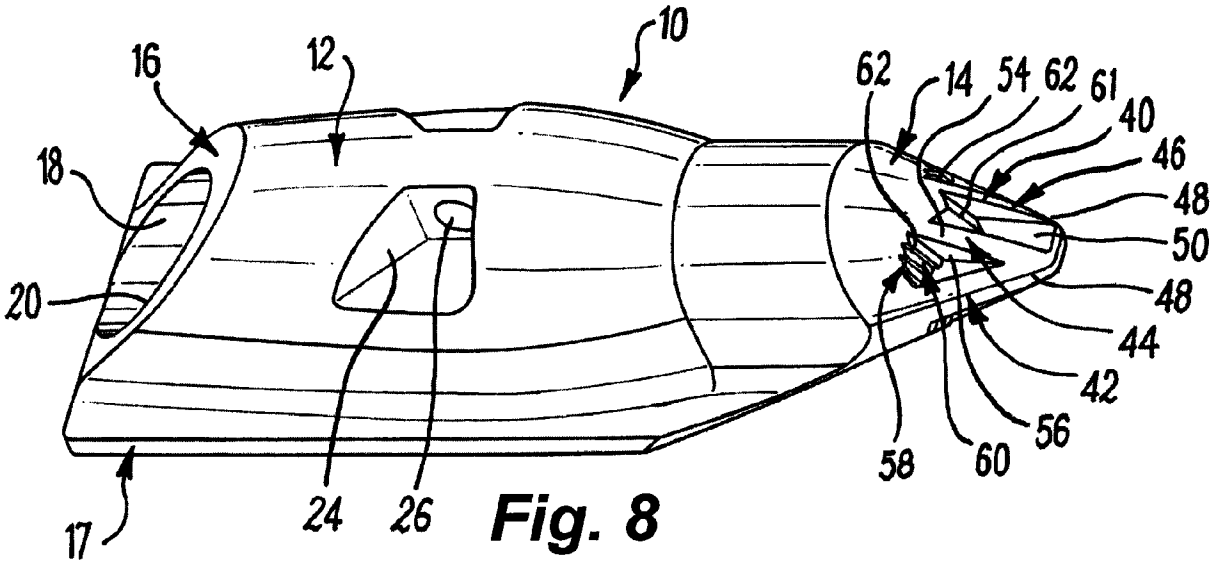
FIG. 8 is a perspective view of the third embodiment of the ground anchor.
Figure 9:
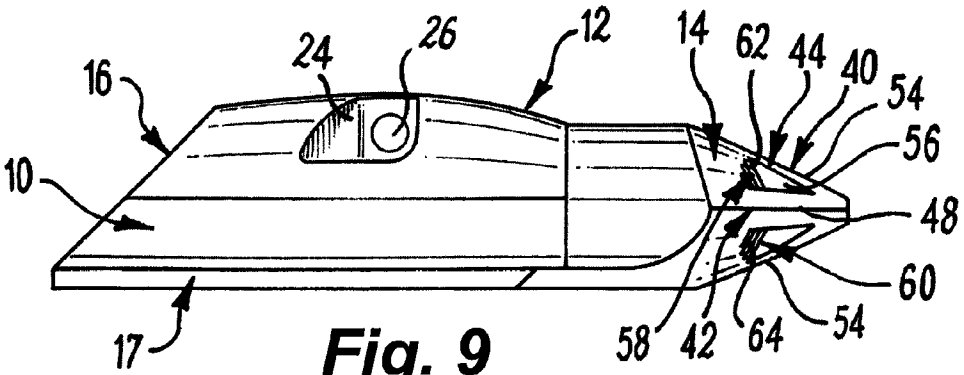
FIG. 9 is a side view of the ground anchor shown in FIG. 8.

A first embodiment of a ground anchor 10 is shown in FIGS. 1 and 2, which is driven into the ground 100 using drive means in the form of an elongate driving rod 22. The driving rod 22 is shown more clearly in FIG. 2. A second embodiment of the ground anchor 10 is shown in FIGS. 3 to 7. A third embodiment of the ground anchor 10 is shown in FIGS. 8 and 9.

The first embodiment of the ground anchor 10, shown in FIGS. 1 and 2, comprises a body 12 having a front end 14 and a rear end 16. Wing portions 17 extend outwardly from a lower region of the body 12. The wing portions 17 provide stability to the ground anchor 10 as it is driven into the ground 100.

A drive formation, in the form of an elongate hole 18 having a blind end 19 (see FIG. 5) is defined in the body 12 from a rear opening 20 at the rear end 16 of the body 12.

The elongate driving rod 22 is inserted into the through hole 18 for the purpose of driving the ground anchor 10 into the ground 100. The driving rod 22 is received in the hole 18 and engages the blind end 19 to enable the driving rod 22 to drive the ground anchor 10 into the ground 100, as explained below.

The body 12 has a securing formation in the form of an apertured portion 24 defining an aperture 26. A flexible elongate member 28, such as a cable, wire or rope, can be received through the aperture 26 to be attached to the body 12, as shown in FIG. 1. The purpose of the flexible elongate member 28 and the apertured portion 24 is to move the ground anchor 10 to a load bearing position when it has been driven into the ground 100 to a desired depth.

By pulling on the flexible elongate member 28, after the driving rod 22 has been removed, the ground anchor 10 is rotated in the direction indicated by the arrow A to a load bearing position, shown in broken lines in FIG. 1 and designated 10A. The flexible elongate member 28 also acts as a load bearing member to bear a load from a structure to be stabilised by the ground anchor 10.

Referring to FIG. 2, the driving rod 22 comprises an elongate cylindrical shaft portion 30 having a proximal end 33 at which an impulse receiving member 34 is provided, and a distal end face 35.

The distal end face 35 engages the blind end 19 when the shaft 30 is received in the hole 18.

In order to drive the ground anchor 10 into the ground 100, a hammer 36 can be used to strike the impulse receiving member 34. The force imparted to the driving rod 22 from the hammer 36 is transmitted to the ground anchor 10 via the engagement between shaft portion 30 and the blind end 19.

When the ground anchor 10 has been driven to the desired depth in the ground 100, the driving rod 22 is removed, and the load bearing member 28 is pulled to rotate the ground anchor 10 to the position shown in broken lines in FIG. 1.

Referring to FIGS. 3 to 7, the second embodiment of the ground anchor 10 is shown. The second embodiment is generally the same as the first embodiment and corresponding features of each embodiment are designated with the same reference numerals.

The ground anchor 10 includes a ground piercing means 40 at the front end of the body 12. The body has a longitudinal main axis X-X (see FIG. 5). The ground piercing means 40 comprises a first tapering member 42, and two second tapering members 44, 46. The second tapering members 44, 46 extend transverse to the first tapering member 42. In the embodiment shown in FIGS. 3 to 7, the first and second second tapering members 44, 46 extend orthogonally to the first tapering member 42. The first tapering member 42 includes a forward projection 42A, which extends forwardly of the second tapering members 44, 46.

The first tapering member 42 also has opposite tapering main edges 48, and opposite substantially parallel planar main faces 50. The main edges 48 taper inwardly towards each other from the body 12. The main edges 48 extend to the forward projection 42A. The main faces 50 extend between the main edges 48, each of the main faces 50 is generally triangular in shape.

Each of the second tapering members 44, 46 has opposite tapering subsidiary edges 54, and opposite substantially parallel planar subsidiary faces 56. The subsidiary edges 54 taper inwardly towards each other from the body 12. The subsidiary edges 54 meet at the main edges 48. The subsidiary faces 56 extend between the edges 54. Each of the subsidiary faces 56 is generally triangular in shape.

In the embodiment described herein, the main and second tapering members 42, 44, 46 provide the advantage that, when driven through matting disposed on the surface of the ground 100, the tapering members 42, 44, 46 part the strands of the matting, and avoid tearing it.

The front end 14 of the body 12 has a convex substantially V shaped formation 60 having an apex 61 and first and second front faces 62, 64, arranged on respective opposite sides of the first tapering member 42. The ground piercing means 40 includes a plurality of teeth 58 on the body 12. The teeth 58 are provided on the first and second front faces 62, 64 adjacent the main and second tapering members 42, 44, 46. The teeth 58 are in the form of serrations that project forwardly from the first and second front faces 62, 64.

The teeth 58 extend transverse to the first tapering member 42. In the second embodiment shown in FIGS. 3 to 7, the teeth 58 extend substantially at right angles to the first tapering member 42.

A third embodiment of the ground anchor 10 is shown in FIGS. 8 and 9, which comprises many of the features of the second embodiment shown in FIGS. 3 to 7. The features shown in FIGS. 8 and 9 which are the same as the corresponding features in FIGS. 3 to 7 have been designated with the same reference numerals as in FIGS. 3 to 7.

The third embodiment differs from the second embodiment, in that the forward projection 42A is omitted. Thus the first tapering member 42 has a flattened front end, thereby increasing the stability of the ground anchor 10 as it is driven into the ground 100.

A further difference is that the first and second front faces 62, 64 are not at right angles to the first tapering member 42, but taper rearwardly therefrom. This facilitates driving the ground anchor 10 into the ground 100.

In the embodiments described herein, the teeth 58 provide the advantage that they assist in the penetration of the ground 100 by breaking stones in the path of the ground anchor 10 as it is driven through the ground 100.

There is thus described a ground anchor 10 which can be driven through matting on the surface of the ground 100 without tearing or otherwise damaging the matting and, as a result of the teeth 58, can be driven easily through stony ground 100.

Various modifications can be made without departing from the scope of the invention. For example, the number of substantially flat tapering members can be varied, and the number of the teeth can be varied.

The invention claimed is:

1. A ground anchor comprising;

a body and a ground piercing means on the body;

wherein the ground piercing means comprises a first tapering member, having two opposite edges, the opposite edges of the first tapering member tapering inwardly from the body towards the other opposite edge of the first tapering member so as to converge to a forward projection of the first tapering member, and the first tapering member having two opposite faces extending between the opposite edges;

wherein the ground piercing means further comprises a plurality of spaced second tapering members extending transverse from each of said faces of the first tapering member;

wherein each of the second tapering members has two opposite edges, the opposite edges of each second tapering member tapering inwardly from the body towards the other opposite edge of the respective second tapering member;

wherein the ground piercing means further includes a plurality of teeth provided on the body in regions adjacent each tapering member;

wherein the first tapering member and the second tapering members define therebetween a pair of opposite cavities, the second tapering members constituting opposite tapering walls of the cavities, and a respective one of said teeth being provided in each of the cavities.

2. A ground anchor according to claim 1, wherein the opposite faces of the first tapering member are substantially parallel to each other.

3. A ground anchor according to claim 1, wherein each of the opposite faces of the first tapering member is substantially planar and substantially triangular.

4. A ground anchor according to claim 1, wherein the ground anchor includes a drive formation for co-operating with a drive means for driving the ground anchor into the ground.

5. A ground anchor according to claim 4, wherein the drive formation is an elongate hole, the elongate hole extending substantially axially into the body from an opening in a rear end of the body.

6. A ground anchor according to claim 5, wherein the elongate hole is an elongate blind hole.

7. A ground anchor according to claim 1, including a securing formation for securing a ground stabilising arrangement thereto, the securing formation comprising an apertured portion of the body, said apertured portion defining an aperture therethrough.

8. A ground anchor according to claim 1, wherein each of the second tapering members has opposite faces extending between the opposite edges of the respective second tapering member, the opposite faces of each respective second tapering member being substantially parallel to one another.

9. A ground anchor according to claim 8, wherein each of the opposite faces of each second tapering member is substantially planar and substantially triangular.

10. A ground anchor according to claim 1, wherein the body has a main axis, and at least one edge of each of the first and second tapering members extends at an acute angle relative to the main axis.

11. A ground anchor according to claim 10, wherein both of the edges of each of the first and second tapering members extend at an acute angle relative to the main axis.

12. A ground anchor according to claim 1, wherein the teeth comprise serrations.

13. A ground anchor according to any claim 1, wherein the body has a front end and a rear end, the ground piercing means being provided at the front end of the body, the ground piercing member further includes a substantially V shaped formation, wherein the substantially V shaped formation includes first and second front faces, each of said front faces extending on a respective opposite side of the first tapering member.

14. A ground anchor according to claim 13, wherein the teeth are provided on said first and second front faces.

15. A ground anchor according to claim 14, wherein the first and second front faces extend transverse to the first tapering member.

16. A ground anchor according to claim 14, wherein the first and second front faces extend substantially at right angles to the first tapering member, and wherein the teeth extend substantially at right angles to the first tapering member.

17. A ground anchor according to claim 14, wherein the first and second front faces taper rearwardly from the first tapering member, and wherein the teeth taper rearwardly from the first tapering member.

* * * * *